United States Patent [19]

Brown

[11] 3,945,659

[45] Mar. 23, 1976

[54] CONVERTIBLE TRAILER VEHICLE AND AMUSEMENT RIDE

[75] Inventor: Joseph Martin Brown, Wichita, Kans.

[73] Assignee: Chance Manufacturing Company, Inc., Wichita, Kans.

[22] Filed: Oct. 25, 1974

[21] Appl. No.: 518,168

[52] U.S. Cl. ..... 280/34 R; 280/36 R

[51] Int. Cl.[2] ..... B62B 11/00

[58] Field of Search ..... 280/34 R, 36 R, 81 R; 52/64, 65

[56] References Cited

UNITED STATES PATENTS

| | | | |
|---|---|---|---|
| 2,413,404 | 12/1946 | Black | 280/36 R |
| 3,428,333 | 2/1969 | Nelson | 280/34 R |
| 3,655,236 | 4/1972 | Hair | 52/65 |
| 3,726,535 | 4/1973 | Longato | 280/34 R |

*Primary Examiner*—Robert R. Song

*Attorney, Agent, or Firm*—Scrivener Parker Scrivener and Clarke

[57] ABSTRACT

A convertible trailer vehicle is provided having a center section and a pair of end sections hinged at opposite corners to the center section. For transport the sections are aligned with each other for towing in a conventional manner by a tractor vehicle. At its destination the respective ends of the trailer swing in a horizontal plane forwardly and rearwardly against the opposite sides of the center section to define a symmetrical platform which may be used for a variety of purposes, particularly for supporting a roundabout amusement ride. The invention also includes the combination of a trailer vehicle and an amusement ride.

13 Claims, 11 Drawing Figures

Fig. 1
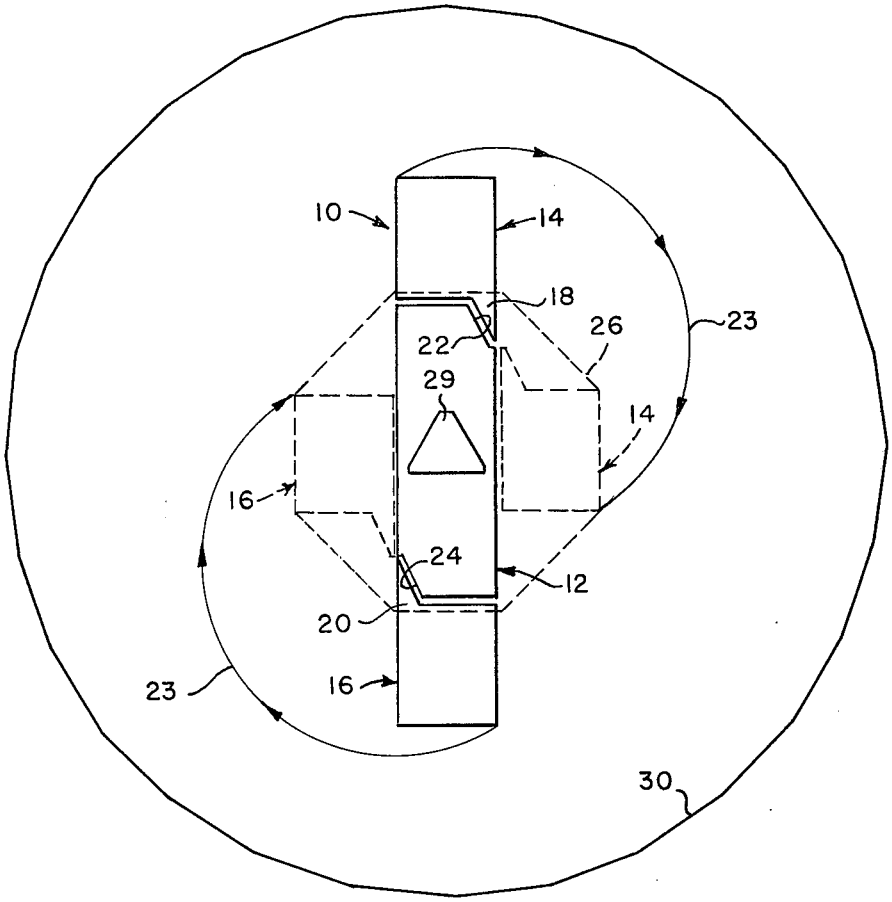
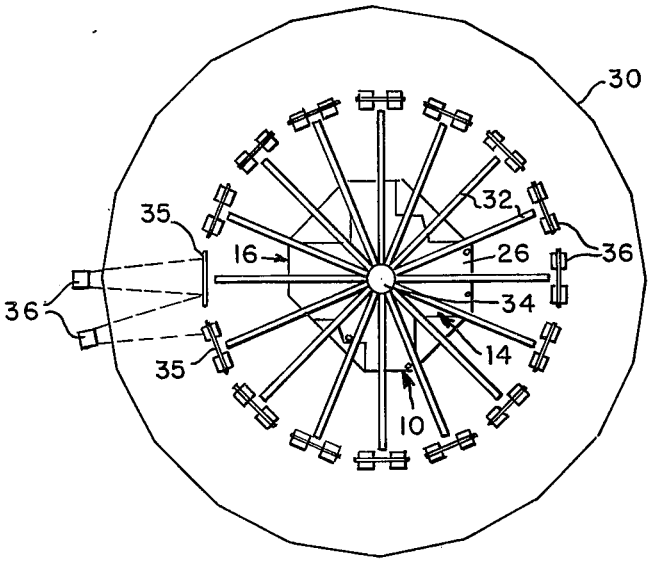
Fig. 2

CONVERTIBLE TRAILER VEHICLE AND AMUSEMENT RIDE

This invention relates to vehicles and more particularly to a convertible trailer vehicle which is particularly though not exclusively adapted for the transport of a roundabout amusement ride. The invention also relates to the combination of a convertible trailer vehicle and an amusement ride.

Amusement rides mounted on trailers with the trailer serving the dual function of a transport vehicle for the ride and a stationary support for the ride in its position of use are well known. However, in most instances the trailer must be provided with outriggers for lateral support for the ride and though attempts to disguise the trailer for decorative reasons are resorted to, the trailer nevertheless remains in evidence, thus giving the ride an appearance of impermanence which is disturbing to some customers.

The broad object of the present invention is to provide a tractor vehicle which is particularly but by no means exclusively adapted for the transport and support of a roundabout amusement ride and wherein the trailer is composed of hinged end sections which may be swung horizontally against opposite sides of a center section to form a platform which is not only adapted to provide firm support for the ride but also disguises completely the character of the trailer.

Still another object of the invention is to provide a convertible trailer of the foregoing nature wherein the hinged end sections not only serve to complete the platform but also serve as outriggers to provide lateral support for a load, such as a ride, carried on the platform.

Yet another object of the invention is to provide a convertible trailer of the foregoing nature which may be used not only for amusement rides but also for a variety of other purposes, such as a bandstand, viewing platform, etc.

Still another object of the invention is to provide a convertible trailer in combination with an amusement ride.

Other objects and their attendant advantages will become apparent as the following detailed description is read in conjunction with the accompanying drawings wherein:

FIG. 1 is a top plan schematic view of the trailer broadly illustrating the manner in which the trailer is converted from its transport to its platform configuration;

FIG. 2 is a schematic top plan view on a reduced scale showing the invention in its platform configuration and supporting a roundabout amusement ride;

FIG. 6 is a perspective, partly-exploded view of the underside of ethe invention in its platform condition, with parts being removed for clarity;

Figure 7:
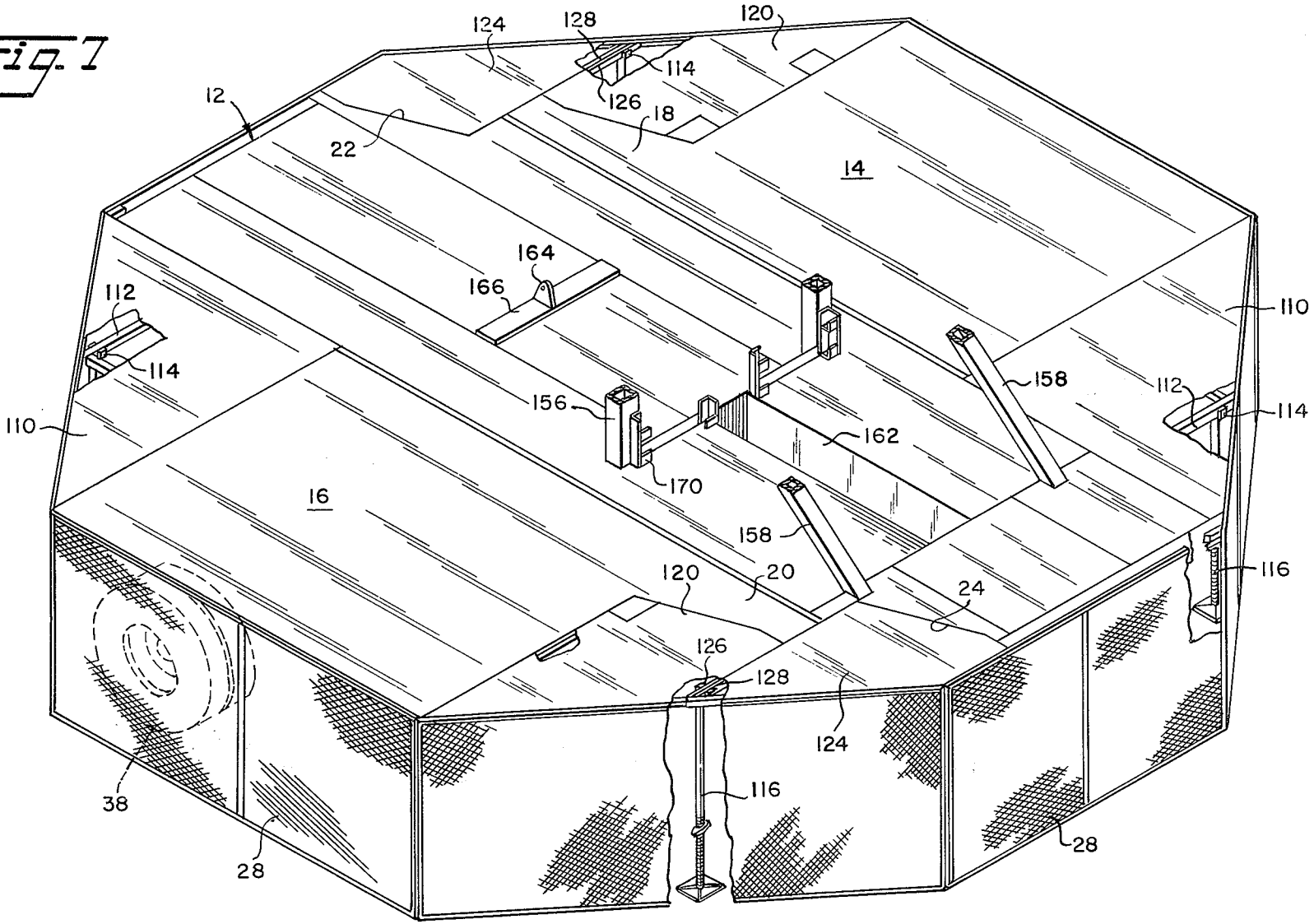
Figure 8:
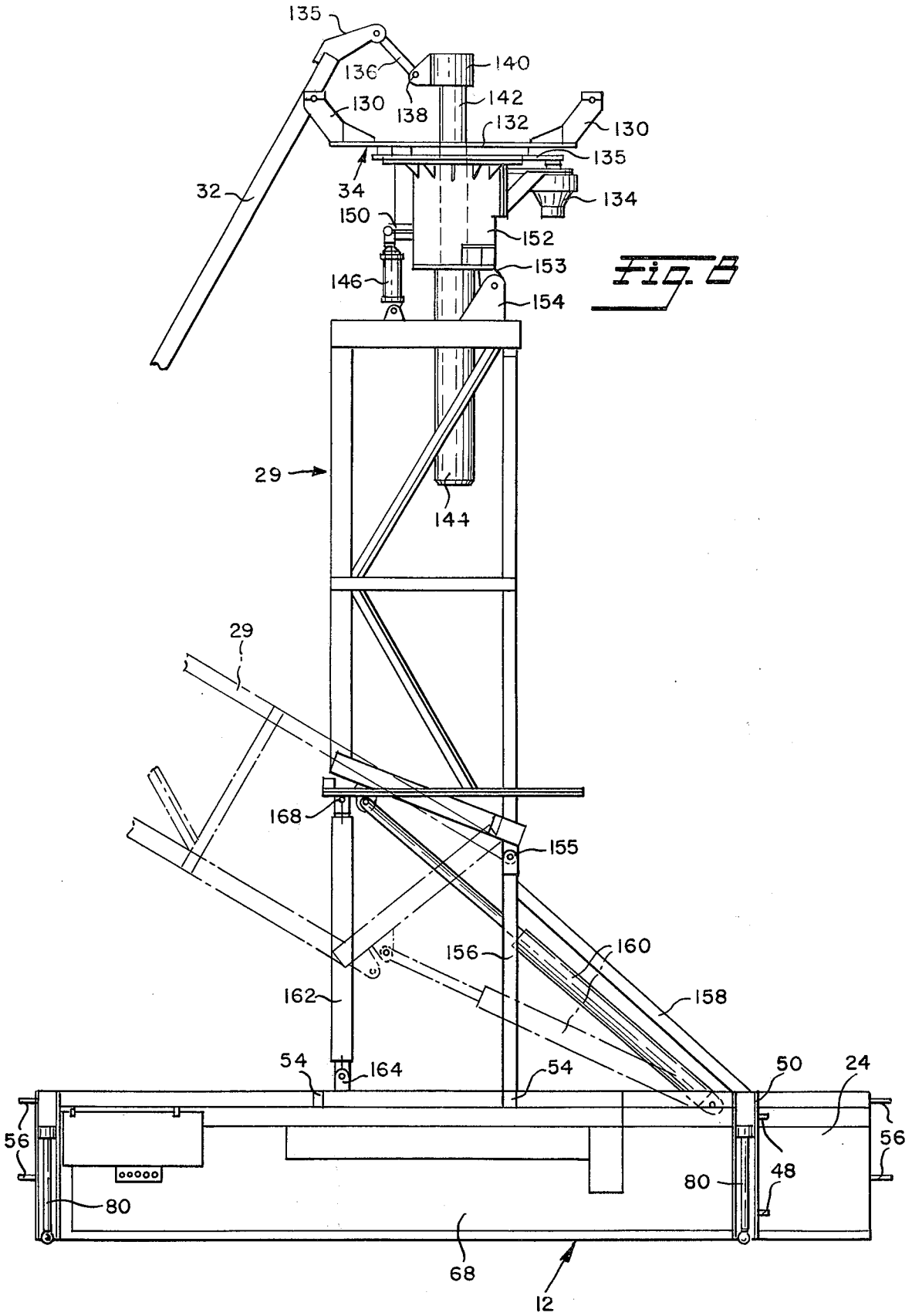

FIG. 7 is a perspective view of the upper side of the completed platform with parts broken away or removed for clarity; and FIG. 8 is a side elevational view of the center section showing the principal features of the ride of the invention mounted on the center section, Referring now to FIG. 1 the numeral 10 designates a trailer vehicle constructed in accordance with the invention. As can be seen the vehicle is composed of three main parts comprising a center section 12 and front and rear sections 14, 16. The latter sections are shorter than the center sections and have respective rearwardly and forwardly projecting extensions 18, 20 at their opposite inner corners which when the sections are aligned as shown by the solid lines of FIG. 1, are received in complementary recesses or cutouts 22, 24 at the corresponding corners of the center section 12. The outer ends of the extensions 18, 20 are hinged to the center section at the inner ends of the recesses and when the trailer vehicle is to be converted to a platform the center section is first jacked up, pins are removed from apertured brackets or gudgeons which lock the sections in aligned transport position, all as hereinafter explained, and the end sections are swung horizontally about their hinges in the direction of the arrows 23 to their dotted line positions where, it will be noted in FIG. 1, the extensions 18, 20 position the sides of the end sections along the sides of the center sections with the rectangular portions of the end sections being laterally aligned with each other and equidistant from the opposite ends of the center section to form a substantially cross-shaped base, the spaces between the arms being bridged by suitably shaped floor plates to form a symmetrical eight sided platform defined by the dotted lines 26. The vertical spaces at the sides of the platform between the floor plates and the ground may be closed by vertical partition members such as fiberglass panels as shown more particularly at 28 in FIG. 4.

Figure 4:
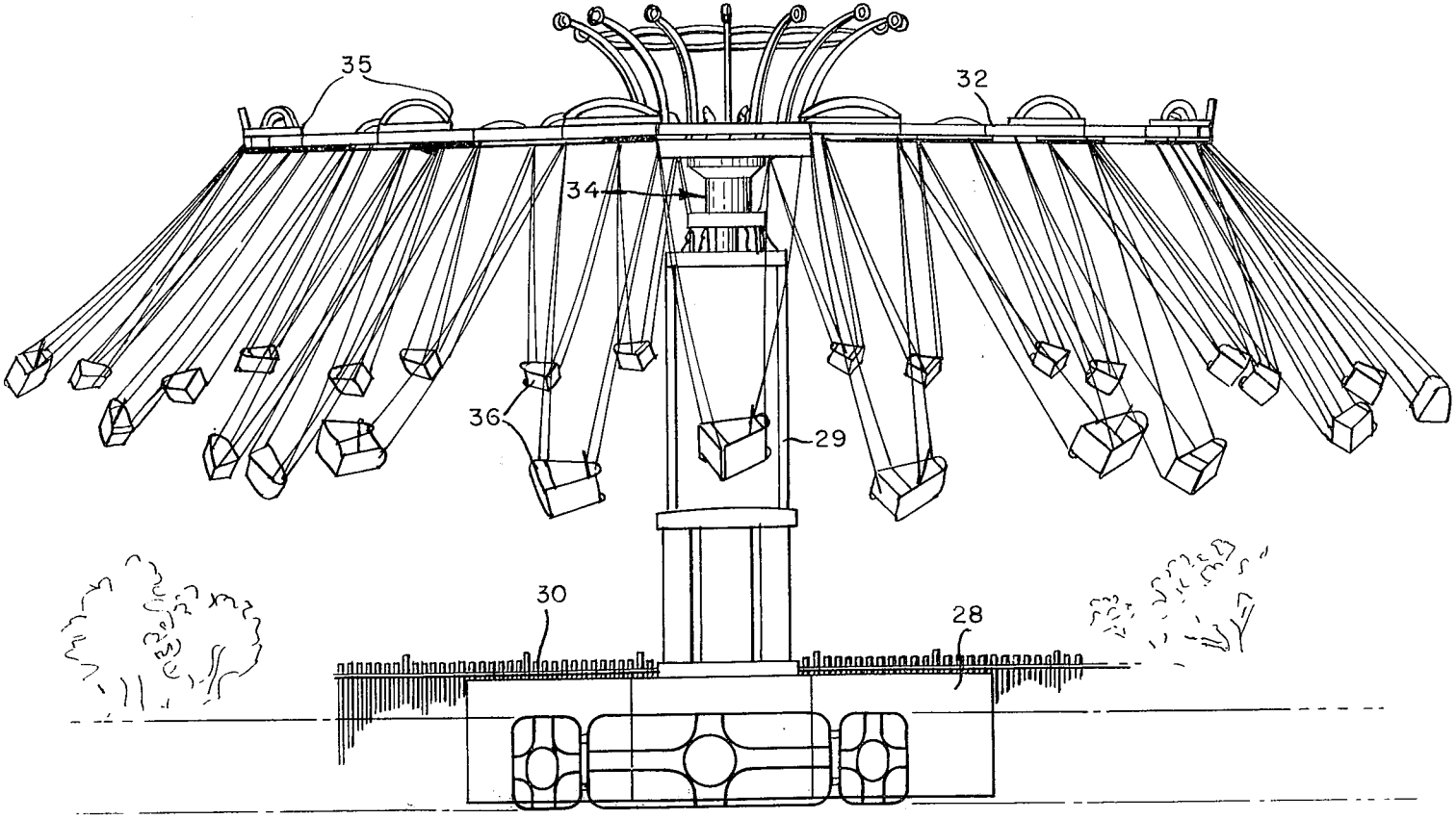
FIG. 4 is a side elevational view of the erected ride of FIG. 3 in operating condition on the platform of the invention.

When the trailer vehicle is to be used in conjunction with an amusement ride, whose triangular support tower is shown schematically at 29 in FIG. 1 and in elevation in FIGS. 4 and 8, the completed platform is surrounded by a suitable fence 30, the overall arrangement of the ride, platform and fence being schematically shown in FIG. 2. The ride may comprise a plurality of elevatable sweeps 32 whose inner ends are connected to a rotating hub 34 which may be raised or lowered while being tilted as later explained in more detail, so as to continuously change the plane of rotation of the sweeps. Each sweep carries at its end a short laterally extending bar 35 and suspended from the end of each bar and between the ends of adjacent bars as shown on the left side of FIG. 2, are swings 36 more clearly shown in FIG. 4. From the foregoing brief description, it will be understood that a variety of thrills will be experienced by riders due to the compound motion imparted to the swings during the course of a ride.

Figures 5, 5A, 5B, 5C:
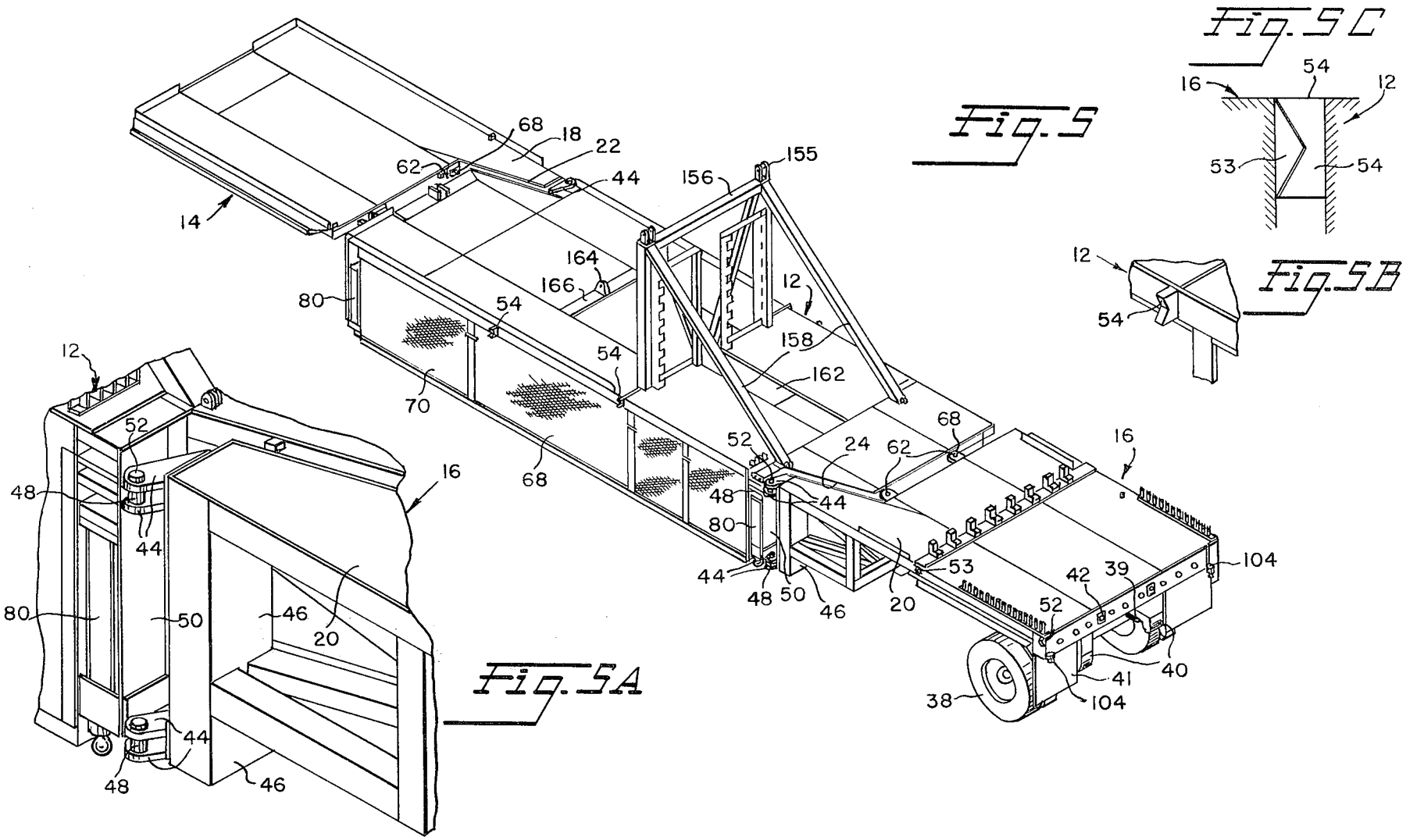
FIG. 5 is a perspective view of the trailer of the invention in its transport condition with the ride removed.
FIG. 5A is an enlarged fragmentary perspective view showing a hinge arrangement in accordance with the invention.
FIG. 5B is an enlarged fragmentary perspective view of a locking member carried by one of the sections of the invention.
FIG. 5C is an enlarged elevational view showing the locking member of FIG. 5B engaged by a mating locking member when the sections are in folded condition.
Figure 5:
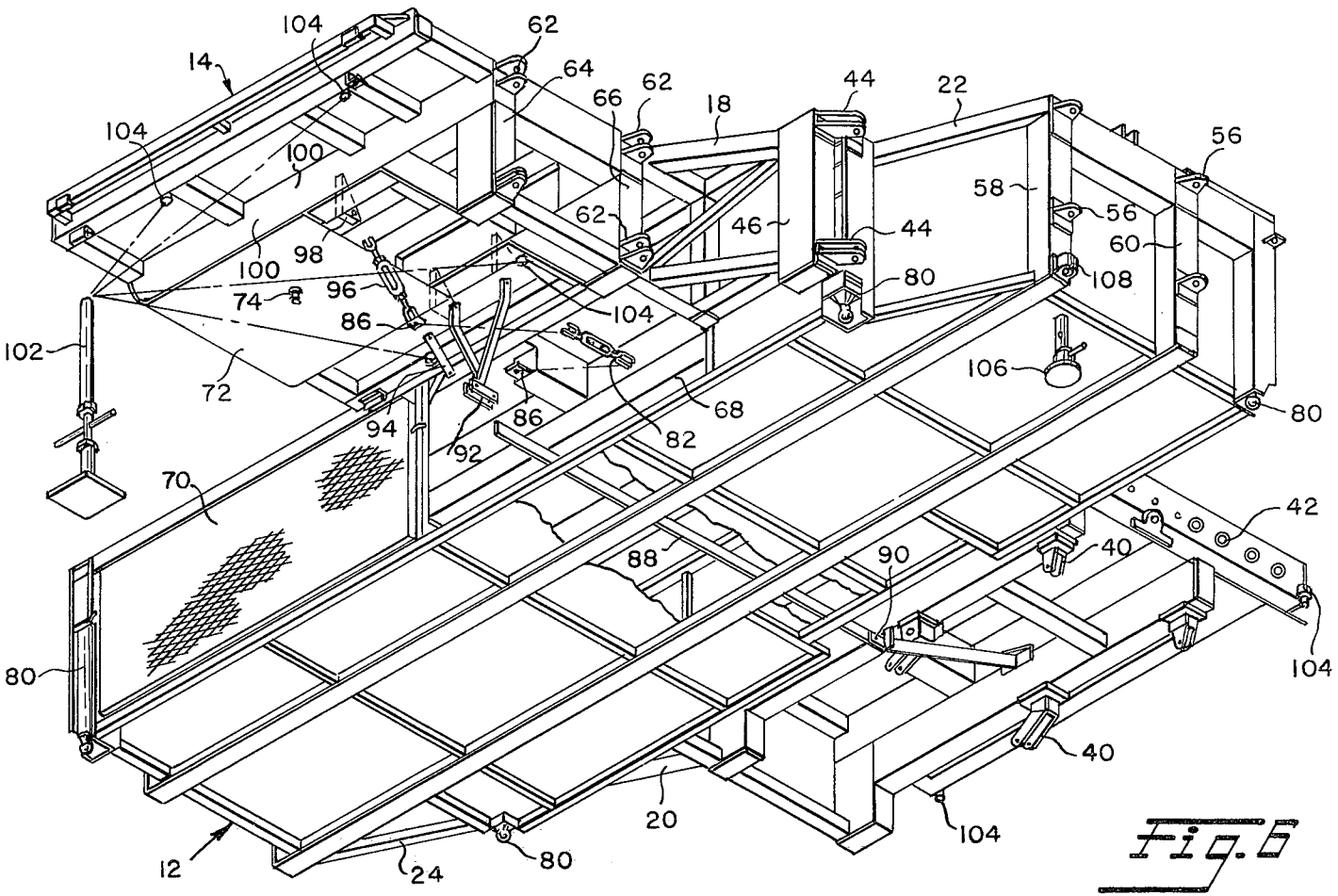

Referring now to FIG. 5 it will be observed that the rear section 16 of the trailer carries a conventional axle and wheels 38 which are carried on leaf springs 39 suspended in the usual manner between brackets 40 best illustrated in FIG. 6 where they are shown with the wheels and axle remove for clarity. The end of the rear sections of the trailer has the usual wheel flaps 41 and rear end lights 42 and between adjacent ends of each of the three sections are suitable electrical connectors (not shown) for interconnecting wiring for the lights. The wheels of the trailer are equipped with fluid pressure brakes (not shown) supplied by the service and emergency conduits in each section and which are together by glad-hand couplings at the adjacent ends of the respective sections when the trailer is in the transport position of FIG. 5. As previously mentioned the front and rear sections 14, 16 of the trailer are hinged to the center section at the end of their respective corner extensions 18, 20. The hinge arrangements for both sections are the same and each comprises two vertically spaced pairs of brackets 44 FIG. 5A welded to a vertical frame member 46 defining the end of the corner extension of each end section. Each pair of brackets embraces a bracket 48 welded to a vertical structural component 50 at the adjacent corner of center section 12 of the trailer. The brackets 44, 48 are provided with aligned openings for the reception of pintles 52, the hinge brackets projecting laterally outwardly sufficiently so that as a trailer end section is swung to its platform position the side of the end section clears the corner of the center section and swings into a position parallel with the corresponding side of the center section. As can be seen in FIG. 5, 5B and 5C disposed on the side of each end section are longitudinally spaced, vertically disposed tapered projections 53, which, when the end sections are folded against the center section nest in complementary notched members 54 on the side of the center section so that when turn buckle fastenings, hereinafter described, are tightened to retain the folded end sections in tight engagement with the center section, the inter-engaging projections and notches restrain the respective sections against relative vertical movement.

The sections are releasably locked in aligned transport position to define a conventional semi-trailer with a king pin at the front for releasable connection with a tractor and wheels at the rear end. The releasable locking means for retaining the sections in their aligned positions comprise an arrangement similar to the hinges just described. That is, the front ane rear ends of the center section are provided with two laterally spaced sets of vertically spaced brackets 56 (FIGS. 6 and 8) welded to vertical frame members 58, 60 of the center section and adapted to be embraced by pairs of vertically spaced brackets 62 welded to vertical frame members 64, 66 of the end sections. The brackets 56, 62 have openings which align with each other to receive pins 68 which lock the trailer in its extended transport position and are readily removable to permit the end sections to be swung to their folded position of FIG. 6.

Beneath the floor of the center section is a compartmentt 68 for the storage of tools, parts, machinery and controls for an amusement ride carried by a trailer. The compartment is closed by doors and panels 70. The forward section 14 of the trailer is provided with the usual bolster plate 72 (see FIG. 6) carrying a king pin 74 which, when the trailer is in the transport condition of FIG. 5, is engageable with the fifth wheel of a conventional tractor.

After the trailer, as so far described, has been positioned by its tractor in its position of use blocking 76 and jack pads 78 (see FIG. 3) are placed beneath hydraulic jacks 80 at the four corners of the center section 12. The jacks are manually operated by controls in the compartment 68 of the center section to first raise the front end of the trailer in order to permit removal of the tractor. Thereafter a turnbuckle (not shown) is connected between a bracket on the rear axle and a structural part of the rear trailer section 16 in order to prevent the rear axle from sagging when the two hydraulic jacks 80 at the rear end of the center section are operated in conjunction with the forward jacks to raise all three of the sections until the rear wheels 38 are clear of the ground by about three inches and the sections are all substantially level. At this juncture, the connecting pins 68 are removed from the brackets 56, 62 and the forward section 14 of the trailer is swung rearwardly and the rear section is swung forwardly until the projections 53 and notched members 54 engage. Thereafter the sections are clamped together by turnbuckles, such as the one shown at 82 in FIG. 6 extending between apertured brackets 84, 86 welded to structural members on the front and rear sections and on the center section, respectively. Though one turnbuckle is shown for purposes of illustration, two or more per side are desireably employed to insure that the sections are clamped rigidly together. In addition, the two end sections are connected to each other by means of an elongated link 88 which extends through the compartment 68 in the center section and is hinged at one end to a suitable bracket 90 carried by the rear section 16 and at its other end to a yoke 92 whose legs are swingable pinned to suitable brackets welded to the underside of the forward section 14. The yoke may be connected by a short link 94 to one end of a double jawed turnbuckle 96 whose opposite end is connected to a bracket 98 welded to a structural part 100 of the forward section 14. When turnbuckle 96 is tightened the two end sections are thus rigidly connected to each other as well as to the center section, the platform thus formed being essentially a unitary structure whose parts are incapable of movement relative to each other.

In order to provide lateral support for the platform a plurality of screw jacks, for example, one similar to the double screw jack 102 shown in FIG. 6 are provided for engagement with bosses 104 welded in the vicinity of each corner of the rear and front sections 16, 14. In addition a single screw jack 106 engageable with a sleeve 108 welded to the lower front end of the center section inboard of the hinge may be provided to further stabilize the platform. When all of the screw jacks have been operated until each bears its proper proportion of the load, the end sections then perform the dual functions of providing platform space while at the same time operating as outriggers for the center section.

After the sections of the trailer have been interconnected and jacked up so as to form the platform as above explained, the spaces between the sections are covered by floor plates as shown in FIG. 7. At the diagonally opposite corners where the straight end of one end section and the adjacent straight side of the center section are located, single triangular floor plates 110 may be provided, the inner edges of the plates being supported on ledges between the corresponding edges of the floor plates fixed to the center and end sections of the trailer and the structural components which underlie the trailer floor plates. The plates 110 have welded to their undersides structural stiffening members 112 which are adapted to be embraced by jaws 114 of a screwjack 116. The hinged corners between the trailer sections are polygonal due to the extensions 18, 20 of the front and rear sections of the trailer and the corresponding recesses 22, 24 of the center section. Conveniently, two suitably shaped floor plates 120, 124 may be used to fill the spaces in these regions, the inner edges of the plates being supported on ledges as are the plates 110, with the outer portions being supported by floor jacks 116 whose jaws embrace abutting structural members 126, 128 of the two plates 120, 124 as shown. The lower part of the platform between the floor plates and the ground is closed by the aforementioned panels 28.

Figure 3:
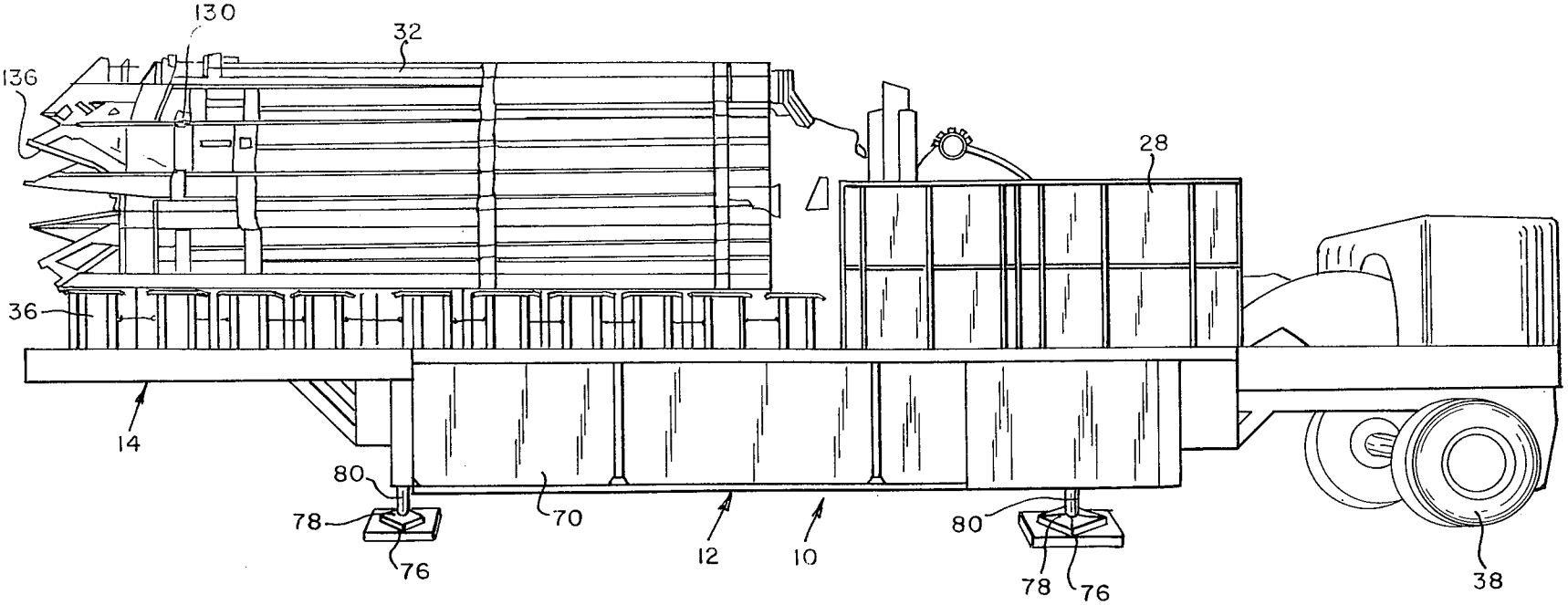
FIG. 3 is a perspective side view of the vehicle of the invention in aligned condition with a collapsed ride and its accessories mounted thereon.

The ride illustrated in FIGS. 2, 3, 4 and 8, and the means for erecting the main support of the ride will now be described. As previously mentioned, the ride consists of radial sweeps 32 which in the transport position of the ride shown in FIG. 3 are folded downwardly about the central triangular tower 29 schematically shown in FIG. 1 and in more detail in FIG. 8. Each sweep 32 is pivoted adjacent one end on a trunion 130 mounted on an annular rotatable platform 132 carried on the aforementioned hub 34 and which is rotated at a speed of about 10 r.p.m. by means of an hydraulic motor 134 and endless flexible drive member 135 such as a roller chain. The inner end of each sweep has an integral off-set arm 135 whose end is connected by a link 136 to a tang 138 of a spider 140 mounted on a suitable rotatable bearing 140 at the outer end of a shaft 142 of a reciprocal hydraulic motor 144. It will be apparent that when the shaft 142 is extended the sweep 132 will be brought towards a vertical position parallel to the tower 29 and that when the piston is retracted the sweep arm moves towards a horizontal position.

The entire operating assembly for the ride as so far described is tiltable relative to the vertical by means of a reciprocating hydraulic tilt motor 146 connected at one end to the top of the tower 29 and an arm 150 of a support member 152 for the rotatable platform 132. The side of the support member opposite the tilt motor 146 is proided with an ear 153 pivotally mounted between trunions 154 fixed to the tower 29. It will be apparent that upon extension and retraction of the tilt motor 146 the plane of rotation of the member 132 and hence the plane of rotation of the sweep varies. Hydraulic fluid is delivered by flexible conduits (not shown) to the rotary drive motor 134 and to the reciprocating motors 144 and 146 from pumping means within the trailer compartment under the control of the ride operator.

As previously mentioned, the tower 29 is a frame structure triangular in cross-section with the base of the triangle being pivoted at 155 to a laterally extending, vertical support frame 156 rigidly fastened to the central section of the trailer and braced by a pair of braces 158 (FIGS. 5 and 8). The apex of the triangular frame is at the left in FIG. 8 and pivotally connected to the lower end of the apex is the outer end of the shaft of a reciprocating hydraulic motor 160 whose inner end is pivoted to the center section of the trailer and operates through an opening 162 (FIGS. 5 and 7) in the center section. It will be apparent that when the tower is in the horizontal phantom line position of FIG. 8 that when the motor 160 is extended, it operates against the lower end of the tower opposite the pivot 155 of the support member 156 causing the tower to rotate about the pivot 155 to the vertical full line position of FIG. 8. After the tower has been moved to this position a leg 162 is connected at its lower end to a bracket 164 carried by a lateral member 166 (see FIG. 5) and at its upper end to a bracket 168 at the lower end of the apex of the tower framework.

When the ride is to be prepared for transport with the parts in the full line position of FIG. 8, the sweep motor 144 is operated to extend the shaft 142 thereof until it has moved the sweeps to a position substantially parallel to the vertical axis of the tower. Obviously, before being brought to a fully collapsed position, the sweeps would first be moved to whatever angular position is convenient for dismantling the swings, lights, etc. With the sweeps fully collapsed, the tower motor 160 is then energized to remove the load from the leg 162 so that it can be disconnected and thereafter the tower and the sweeps are lowered by the motor to the full horizontal position of FIG. 3. The floor plates, fiberglass panels, and jacks 102 beneath the end sections of the trailer and the turnbuckles connecting the sections together are removed and the end sections swung back to the aligned positions of FIG. 5 with the glad-hand coupling and electrical connectors being joined together during this movement and when the apertures in the connector brackets 56, 62 are aligned the connector pins 68 are inserted. In the aligned position, some of the turnbuckles may then be used between the center and end sections to more rigidly connect the sections together and prevent working of the locking pins in their bracket apertures. Upon the completion of the foregoing steps, all of the parts of the ride are then stowed on or in the trailer in their allotted places, the trailer being provided with pedestals 168, storage frames or racks 170 and the like adapted to receive mating portions of the various components of the ride.

After the fifth wheel of the tractor has been positioned around the trailer king pin, the hydraulic jacks of the center sections are retracted to lower the trailer to its normal transport position and finally the turnbuckle between the rear axle and the trailer section is removed so that the trailer is in all respects in condition for towing to its next destination.

It is not believed that any further description of the trailer or ride is necessary in order to comprehend the features of the invention. It will be apparent, of course, that the invention is susceptible of a variety of changes and modifications without, however, departing from the scope and spirit of the appended claims.

What is claimed is:

1. A convertible trailer vehicle comprising a plurality of sections, hinge means interconnecting the adjacent ends of two sections at a position laterally off-set from the longitudinal center lines of said sections in positions enabling one section to be swung horizontally relative to the other between an aligned position and a side-by-side position, and releasable locking means separate from said hinge means for retaining said sections in their aligned positions, one of said sections constituting a front section and another of said sections constituting a rear section when said sections are in their aligned positions, trailer wheel means carried only by said rear section, and towing means for releasable connection to a tractor vehicle carried by said front section whereby said trailer functions substantially as a conventional semi-trailer when said sections are releasably locked in their aligned positions.

2. The convertible trailer vehicle of claim 1 including other releasable locking means for retaining said sections in their side-by-side positions.

3. The convertible trailer vehicle of claim 1 wherein said sections are substantially rectangular, one of said sections being shorter than an adjacent section, the laterally off-set hinge means being disposed at the adjacent corners of the respective sections.

4. The convertible trailer vehicle of claim 3 including an extension at the corner of the shorter section and a complementary recess at the adjacent corner of the longer section, said hinge means being disposed at the outer end of said extension and the inner end of said recess, said extension having a length such that when said shorter section is swung to its side-by-side position with the longer section, the ends of said shorter section are positioned substantially equidistant from the ends of said longer section.

5. The convertible trailer vehicle of claim 1 wherein the plurality of sections comprise a center section and a pair of end sections, the hinge means interconnecting one of said end sections to said center section being off-set on the opposite side of said center line from the hinge means of the other end section whereby the end sections may be swung to their side-by-side positions on opposite sides of said center sections.

6. The convertible trailer vehicle of claim 5 wherein the three sections of said trailer are substantially rectangular and have substantially equal widths, the laterally off-set hinge means for the respective end sections being disposed at the diagonally opposite corners of said center section and at the adjacent corner of the respective end sections.

7. The convertible trailer vehicle of claim 6 wherein the end sections are shorter than the center section, an extension at the adjacent corner of each of said end sections and a complementary recess in each of the diagonally opposite corners of the center section, said hinge means being disposed at the outer end of each said extensions and at the inner end of the respective recesses, said extensions having lengths such that when said end sections are swung into their side-by-side positions with opposite sides of the center section the ends of each of said end sections is positioned substantialy equidistant from the ends of said center section.

8. The convertible trailer vehicle of claim 7 wherein the end sections are of substantially equal length.

9. The convertible trailer vehicle of claim 1 including said rear section, towing means carried by said front section, jack means operable to raise and lower said center and end sections sufficiently to enable said end sections to be swung between their side-by-side and aligned positions relative to said center section.

10. The convertible trailer vehiclel of claim 9 wherein said jack means are operable on said center section to raise said trailer for swinging movement of said end sections, and other jack means operable on said end sections when in their side-by-side posiitions to provide lateral support for said center section.

11. The convertible trailer vehicle of claim 10 wherein the end sections are equal in length to each other while being shorter than said center section, an extension at said adjacent corner of each of said end sections and a complementary recess in each of the diagonally opposite corners of the center section, said hinge means being disposed at the outer end of each of said extensions and the inner end of the respective recesses, said extensions having lengths such that when said end sections are swung to their side-by-side positions with the opposite sides of the center section, the ends of each of said end sections are positioned substantially equi-distant from the ends of said center section.

12. The convertible trailer vehicle according to claim 1 including projections means on the side of one of said sections and complementary recess means on the side of the other section, the projection and recess means being positioned and shaped so as to inter-engage with the other when said sections are in their side-by-side positions and in a manner which restrains relative vertical movement between said sections, and releasable clamping means for rigidly clamping said sections together in their side-by-side positions.

13. A convertible trailer vehicle according to claim 12 wherein said clamping means comprises turnbuckle means.

* * * * *